United States Patent [19]

Rynard

[11] 3,979,574

[45] Sept. 7, 1976

[54] TANK TYPE ENGINE HEATER

[75] Inventor: Richard Haig John Rynard, Toronto, Canada

[73] Assignee: Canadian General Electric Company Limited, Toronto, Canada

[22] Filed: Mar. 31, 1975

[21] Appl. No.: 563,711

[52] U.S. Cl. ..... 219/208; 123/142.5 E; 219/306; 219/318; 219/336; 219/536

[51] Int. Cl.[2] ..... H05B 3/82; F02N 17/06; F24H 1/10

[58] Field of Search ..... 219/202, 205, 208, 306, 219/310, 312, 316, 318, 331, 335, 336, 523, 536, 542, 526; 123/142.5 E, 142.5 R

[56] References Cited

UNITED STATES PATENTS

| | | | |
|---|---|---|---|
| 1,875,306 | 8/1932 | Williams | 219/318 |
| 2,367,197 | 1/1945 | Caldwell | 219/208 |
| 2,400,838 | 5/1946 | Olson | 123/142.5 E |
| 2,408,403 | 10/1946 | Babson et al. | 219/312 X |
| 3,209,123 | 9/1965 | Windsor | 219/208 |
| 3,646,314 | 2/1972 | Windsor | 219/336 X |
| 3,766,356 | 10/1973 | Feldmann | 219/336 X |

FOREIGN PATENTS OR APPLICATIONS

| | | | |
|---|---|---|---|
| 165,329 | 9/1955 | Australia | 219/328 |
| 1,059,165 | 11/1953 | France | 219/336 |
| 113,061 | 3/1968 | Norway | 219/306 |
| 1,088,250 | 10/1967 | United Kingdom | 219/336 |
| 760,990 | 11/1956 | United Kingdom | 219/318 |

*Primary Examiner*—A. Bartis
*Attorney, Agent, or Firm*—Raymond A. Eckersley

[57] ABSTRACT

An electric tank heater for heating the engine coolant system of an automotive vehicle comprises a tubular tank shell having an open end in which is secured an annulus having a U-shaped wall. The outer leg of the annulus is circumferentially secured and sealed the shell. The inner leg extends inwardly through the end of the shell and is spaced from the inner surface thereof. A removable closure plug member from which an electric immersion heating element depends for projection into the shell is inserted into the annulus and seals against the inner leg thereof with an O-ring seal. The closure plug member is retained in place by a yoke engaging the edge of inner leg.

4 Claims, 2 Drawing Figures

FIG. 1
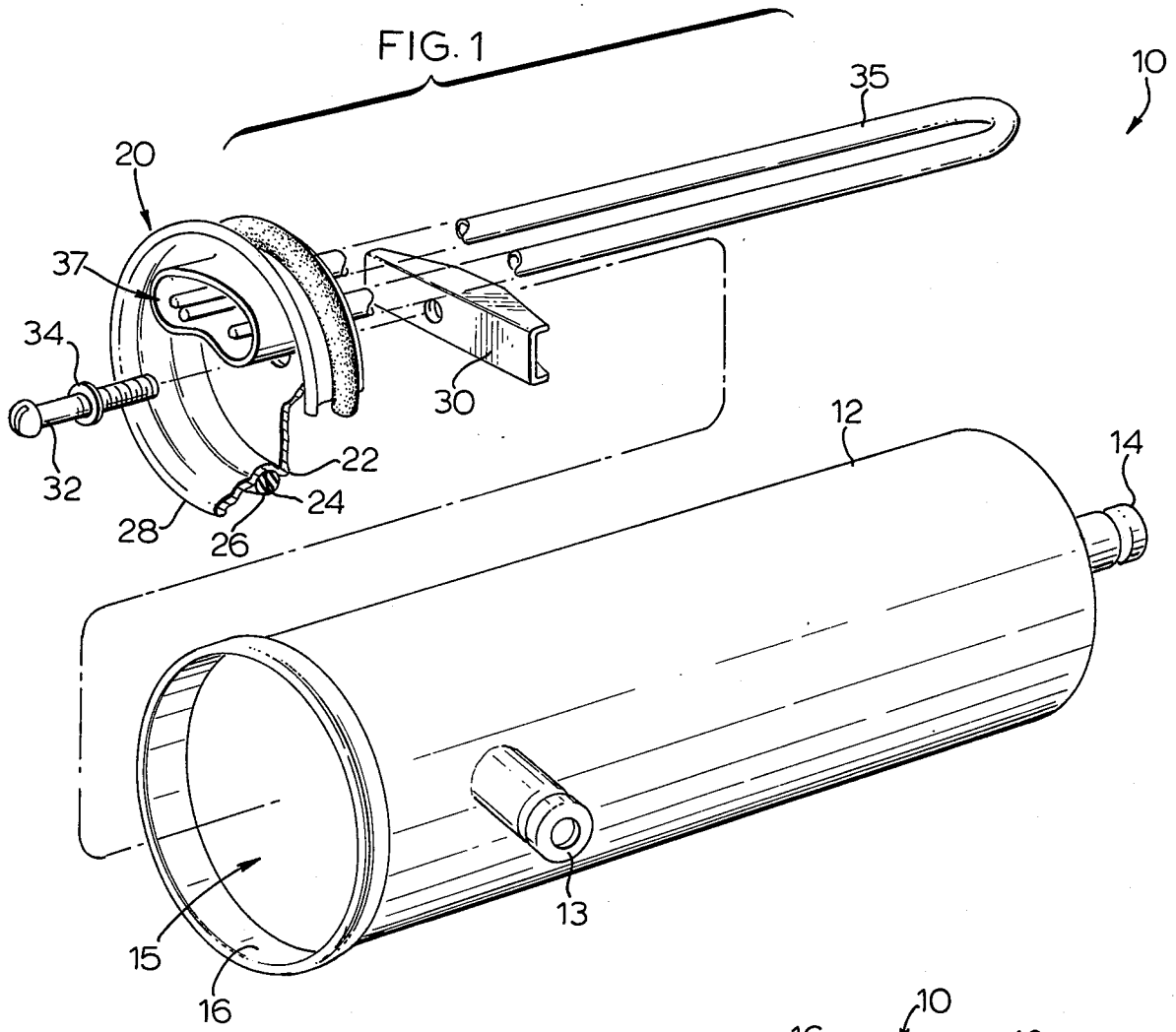
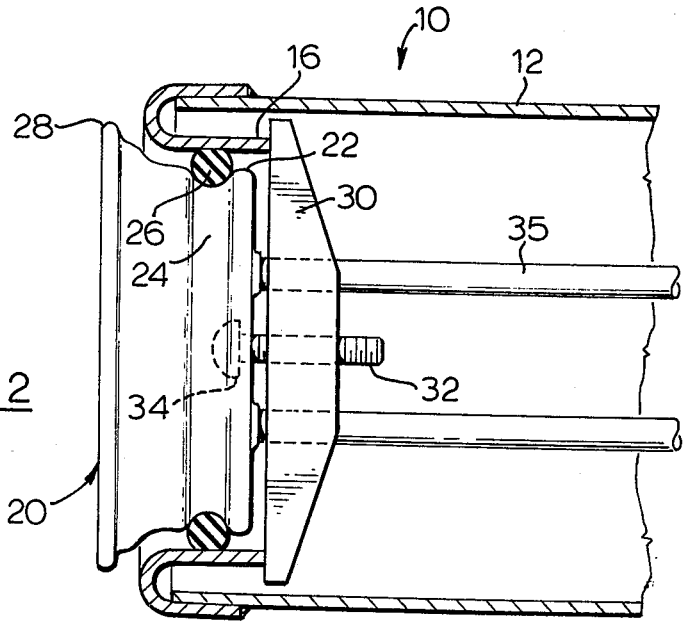
FIG. 2

TANK TYPE ENGINE HEATER

This invention concerns engine heaters for automotive vehicles. It particularly concerns improvements to tank type electric immersion heaters.

Electric heaters for automotive vehicle engines employing water as an engine coolant are typically of two types: those wherein the heating element is inserted in the coolant surrounding the engine block (block heaters) and those wherein a separate chamber containing the heating element is branched into the coolant system (tank heaters). In both types the heating elements are of the metal sheathed design, for example as manufactured under the trademark Calrod. The spatial restrictions are such that the heat output/unit area of heating element is generally in excess of that commensurate with long life of the element.

It appears anomalous that relatively inexpensive block heaters are designed to be readily replaced, whereas the more complex and expensive tank heaters generally have no provision for demounting the heating element and require the total replacement of the unit.

The apparent anomaly may be ascribed to the fact the heaters are subject to accidental damage from flying stones, mechanic's tools and the like. In block heaters, the engine block provides one sealing surface, and this is sufficiently robust that it is not deformed accidentally. Tank heaters are generally constructed from a relatively light gauge metal, and are thus much more likely to be deformed accidentally to the point where a leak occurs. In known tank type heaters wherein the heating element is demountable, the area surrounding the seal is generally highly engineered, thus adding significantly to the cost of the heater. My invention proposes a simple, inexpensive sealing arrangement for tank type heaters wherein the sealing surfaces are relatively isolated and protected from deforming blows or other accidental damage.

Briefly stated, my invention comprises a tank heater which includes a shell having an opening therein. A cylindrical wall contained within the shell seals integrally to the opening; a plug member has an annular peripheral wall adapted to enter the opening concentric with the cylindrical wall, and a seal such as an O ring seal is situated between the cylindrical wall and the peripheral wall to seal the opening. The plug is retained in its closure position in the opening by any convenient means. The heating element, which depends from the plug to project into the shell, may thus be replaced simply by removing the retaining means and withdrawing the plug from the shell.

My invention will be further described in conjunction with a preferred, illustrated embodiment thereof wherein FIG. 1 shows a perspective view of a tank heater, partially exploded and partially broken away, and FIG. 2 shows a side view, partially in section, of the sealing means of FIG. 1.

In the figures a tank heater 10 is shown as comprising a shell 12 having a water inlet conduit 13 and a water outlet conduit 14. Shell 12 has an opening 15, to which is sealed a cylindrical wall 16 which is contained within shell 12. In the preferred form shell 12 has a simple tubular form and opening 15 comprises an open end of the tube. Whilst it is possible to roll form the wall forming shell 12 adjacent opening 15 such that a portion of wall 12 becomes re-entrant, thus forming internal, cylindrical wall 16, it is generally preferred for reasons to be disclosed that wall 16 be formed separately from wall 12 and sealed thereto as by brazing or welding.

Opening 15 is closed by a conventional plug member 20 using an O ring seal 26 in a manner generally disclosed in Canadian Pat. No. 850,767 issued Sept. 1, 1970 to Ehgoetz, commonly assigned herewith. Briefly, plug 20 includes an annular wall portion 22 having a groove 24 with an O ring 26 mounted therein. Peripheral wall 22 is adapted to enter opening 15 such that O ring 26 engages cylindrical wall 16 thereby sealing the opening. Plug 20 may have an enlarged annular wall portion 28 forwardly connected to wall 22 to preclude plug 20 from penetrating too far into opening 15. Plug 20 has a heating element 35 dependently affixed thereto such that when plug 20 is in its closure position the element projects within shell 12. Electrical contact portions 37 of element 35 project from the opposed side of plug 20 for interconnection to an electrical supply cord.

Plug 20 is retained in its closure position by any convenient means. That illustrated is shown in the above referenced Ehgoetz patent. Other means are disclosed in Canadian Pat. No. 700,836 issued Dec. 9, 1964 to Heinbuch commonly assigned herewith. Still other means are known in the art. Briefly, the illustrated means comprise a yoke 30 which engages a shoulder provided internally of shell 12 but facing away from opening 15. This shoulder is herein formed by distal edges of cylindrical wall 16. A screw 32 interconnects yoke 30 and plug 20 to provide tension therebetween. Screw 32 is sealed in relation to plug 20 by washer 34.

As a manufacture it is preferred that shell 12 be of simple tubular form; a tube 12 is most economically formed from flat stock such as sheet or strip, and by butt welding the seams. It would be quite possible to roll the end of tube 12 such that a portion thereof becomes re-entrant, thereby forming inner cylindrical wall 16 concentric with wall of tube 12 and spaced therefrom. However the areas adjacent the weld are generally rough and a separate machining operation would be necessary to permit sealing with sealing ring 26. Rather, I prefer to form this wall structure by providing a wall 16 separately from tube 12, and attaching it thereto as by brazing. The preferred form of the separately formed portion constituting wall 16 is an annulus having a U shaped radial cross section. Such annulus is struck from sheet metal to provide a gently flared opening 15 which facilitates entry of plug 20. Additionally, tube 12 is considerably rigidified in the venerable end area whereby the possibility of deformation of internal wall 16 is still further diminished.

It will be apparent that many variations of this embodiment will be possible, hence the scope of the invention is to be taken as being defined by the appended claims.

What I claim as new and desire to secure by Letters Patent of the United States is:

1. In a tank heater comprising a shell having liquid inlet and outlet conduits and having an opening therein adapted to be closed by a closure means including a closure member, said closure member having an electric immersion heating element dependent therefrom to project into said shell, said closure member comprising a plug having an annular wall portion, an O ring sealing member girdling said annular wall portion, and means to retain said closure member in its closed position, the improvement wherein said closure means includes an annulus having a U-shaped wall, the outer leg thereof being circumferentially connected in sealed relation to said opening, the inner leg thereof extending inwardly of said opening and being spaced from the inner surface of said shell, said O ring sealing member engaging said inner leg when said closure member is inserted into said annulus.

2. A tank heater as defined in claim 1, wherein said shell comprises a tube and wherein said opening comprises one end of said tube.

3. A tank heater as defined in claim 2 wherein said annulus is formed separately from said tube wall.

4. A tank heater as defined in claim 3 wherein said retaining means includes a yoke engaging shoulders formed by the edge of the inner leg of said annulus.

* * * * *